United States Patent [19]

Malcolm

[11] 4,219,865

[45] Aug. 26, 1980

[54] ENERGY CONVERSION UNIT FOR ELECTROSTATIC SPRAY COATING APPARATUS AND THE LIKE

[75] Inventor: David H. Malcolm, Randolph, N.J.

[73] Assignee: Speeflo Manufacturing Corporation, Houston, Tex.

[21] Appl. No.: 939,171

[22] Filed: Sep. 5, 1978

Related U.S. Application Data

[63] Continuation-in-part of Ser. No. 754,161, Dec. 27, 1976, abandoned.

[51] Int. Cl.[2] ..... B05B 5/02

[52] U.S. Cl. ..... 361/228; 361/235

[58] Field of Search ..... 361/228, 229, 227, 235; 415/119; 310/216; 239/15; 290/43, 54

[56] References Cited

U.S. PATENT DOCUMENTS

| | | | |
|---|---|---|---|
| 1,360,654 | 11/1920 | Littlefield | 361/228 |
| 2,897,596 | 8/1959 | Maurer | 415/119 |
| 3,293,467 | 12/1966 | Favre | 310/216 |
| 3,610,528 | 10/1971 | Fellici | 239/15 |
| 3,653,592 | 4/1972 | Cowan | 361/227 |
| 3,731,145 | 5/1973 | Senay | 361/235 |
| 3,745,413 | 7/1973 | Whitmore | 361/229 |

*Primary Examiner*—J. D. Miller
*Assistant Examiner*—L. C. Schroeder
*Attorney, Agent, or Firm*—Pearne, Gordon, Sessions

[57] ABSTRACT

An improved energy converting and electric power generating system for electrostatic spray apparatus for coating systems adapted to convert the kinetic energy available in a moving air stream into electrical power.

16 Claims, 6 Drawing Figures

ENERGY CONVERSION UNIT FOR ELECTROSTATIC SPRAY COATING APPARATUS AND THE LIKE

This application is a continuation in part of my pending application Ser. No. 754,161 filed Dec. 27, 1976, now abandoned.

This invention relates to electrostatic spray coating systems wherein the deposition of coating materials upon a workpiece is enhanced through the application of electrostatic forces and particularly to an improved self contained energy converting and electric power generating system for electrostatic spray gun apparatus adapted to convert the kinetic energy of a moving air stream into electric power.

Electrostatic spray coating systems of both the air atomized and airless types are widely utilized in paint spraying and for deposition of other coating materials. Spray gun apparatus conventionally employed therein is generally constituted by an insulating barrel member having a grounded handle or mount disposed at one end thereof and a selectively sized and shaped high voltage electrode extending from the other end thereof disposed adjacent to the locus of atomization. Such electrode is usually charged to a potential in the neighborhood of from 30 to 85 kilovolts, and in certain installations as high as 150 kilovolts, to create a corona discharge condition and a concomitant electric field of appreciable magnitude. Under such conditions, the corona discharge current flowing from the high voltage electrode creates a region adjacent to the locus of atomization rich in unipolar ions that attach themselves to and charge the paint or other coating material spray droplets. Alternatively, for conductive coating materials contact charging of the spray droplets will occur in the high field strength region around the fluid orifice. The charged droplets are then displaced, under the conjoint influence of their own inertial forces and the electrostatic field extant in the spray region, toward a grounded workpiece. In accord with conventional practice, maximum paint savings are generally effected by maintaining the charging voltage as high as possible and of such magnitude as to produce an average depositing field strength of at least 5,000 volts/inch, and preferably as high as 10,000 volts/inch, between the spray gun and the workpiece. As a concomitant thereto, the spray velocity in the vicinity of the workpiece should be of minimal magnitude consistent with the demands of adequate atomization and paint flow.

The requisite charging voltages are conventionally obtained either through the utilization of externally located standard electronic high voltage power supplies or by the incorporation of an electrogasdynamic high voltage generator within the spray gun body. The standard electronic high voltage power supplies are relatively large, heavy and expensive and are so constituted as to inherently function with essentially "constant voltage" type characteristics. In addition thereto and because of the magnitude of the potentials involved, the high voltage cable interconnecting such power supply with the spray gun is heavy, bulky and relatively inflexible, adding undesired weight to the gun assembly which, because of the concomitant high voltage insulation requirements is rendered unduly large, complex and in most instances not field serviceable.

While the electrogasdynamic powered spray coating apparatus is possessed of several advantageous features as compared to the standard high voltage power supplies, such conventionally require external generation of the relatively low, but still multi-kilovolt, excitation potentials for the spray apparatus contained electrogasdynamic generator and as such, require utilization of an external power supply connected to the spray head as well as requiring the use of pre-conditioned or "seeded" air for reliable operation thereof.

The avoidance of dependence upon a "seeded" air supply and the minimization, if not elimination, of all external power supplies and associated electrical connections to the electrostatic spray apparatus has been a long-sought objective in this field. However, the antithetical requirements of required high operating potentials with attendant current limiting or constant current characteristics, the required utilization of conventionally available compressed air supplies and the avoidance of deleterious discharge potentials, all within the framework of light weight, small size and extended trouble-free operation over long periods of time have effectively precluded, despite various suggested solutions, practical realization of this objective.

Application Ser. No. 754,161 of Dec. 27, 1976, now abandoned, discloses an improved construction for a light weight hand manipulable electrostatic spray coating apparatus incorporating an entirely self contained electrical power supply that broadly incorporates a series of means for converting the kinetic energy of a moving air stream into high voltage electrical energy appropriate for application to the spray apparatus charging electrode. This application disclosure is particularly directed to a construction for an improved and diminutive self contained primary energy conversion system for spray guns adapted to convert the kinetic energy of a moving air stream into primary electrical energy. In its broad aspects the subject invention includes a selectively sized and arranged light weight high speed impulse type air motor directly driving a compatible magnetic armature low voltage alternator adapted to provide an effectively instantaneous voltage output in response to demand for power. In its narrower aspects, the subject power converter includes an air motor alternator combination adapted to rapidly accelerate to required speed in response to demand for power and to provide demanded power in an efficient and reliable manner over an extended operating life. In a still narrower aspect the subject invention includes the selective combination of a diminutive air motor and directly driven alternator operative within a framework of specific mechanical and electrical operating parameters and adapted to utilize conventional plant compressed air supply as the prime movant and sole source of input energy.

Among the advantages of the subject invention is the permitted provision of an entirely self contained electrical power generating system for electrostatic spray coating apparatus that derives its electric energy solely through direct conversion of the kinetic energy of a moving air stream. Another advantage of the subject invention is the provision of a cartridge type of energy conversion unit in the form of an essentially monolithic assembly that is individually replaceable for easy field servicing thereof. Still further advantages include the provision of a diminutive energy conversion unit that is completely free of any external electrical power connections and requires only an available, conventional source of plant compressed air for operability.

The primary object of this invention is the provision of a light weight and diminutive energy conversion unit for electrostatic spray coating apparatus.

Another object of this invention is the provision of an energy conversion unit of such diminutive size as to be disposed within an electrostatic spray coating apparatus and that utilizes compressed air as the prime movant power source therefor.

Still another object of the subject invention is the provision of a field replaceable cartridge type of energy conversion unit for electrostatic spray devices adapted to convert the kinetic energy of a moving air stream into electrical energy and to thereby dispense with the need for any external electrical connection thereto.

A still further object of the subject invention is the provision of an improved and readily replaceable energy conversion system in cartridge form for electrostatic spray apparatus that effectively removes all diagnostic, repair and maintenance operations associated with electrical power generation from the operator of the system.

Other objects and advantages of the subject invention will be apparent from the following portions of this specification and claims and from the appended drawings which illustrate, in accord with the mandate of the patent statutes, a presently preferred construction incorporating the principles of this invention.

REFERRING TO THE DRAWINGS

Figure 1:
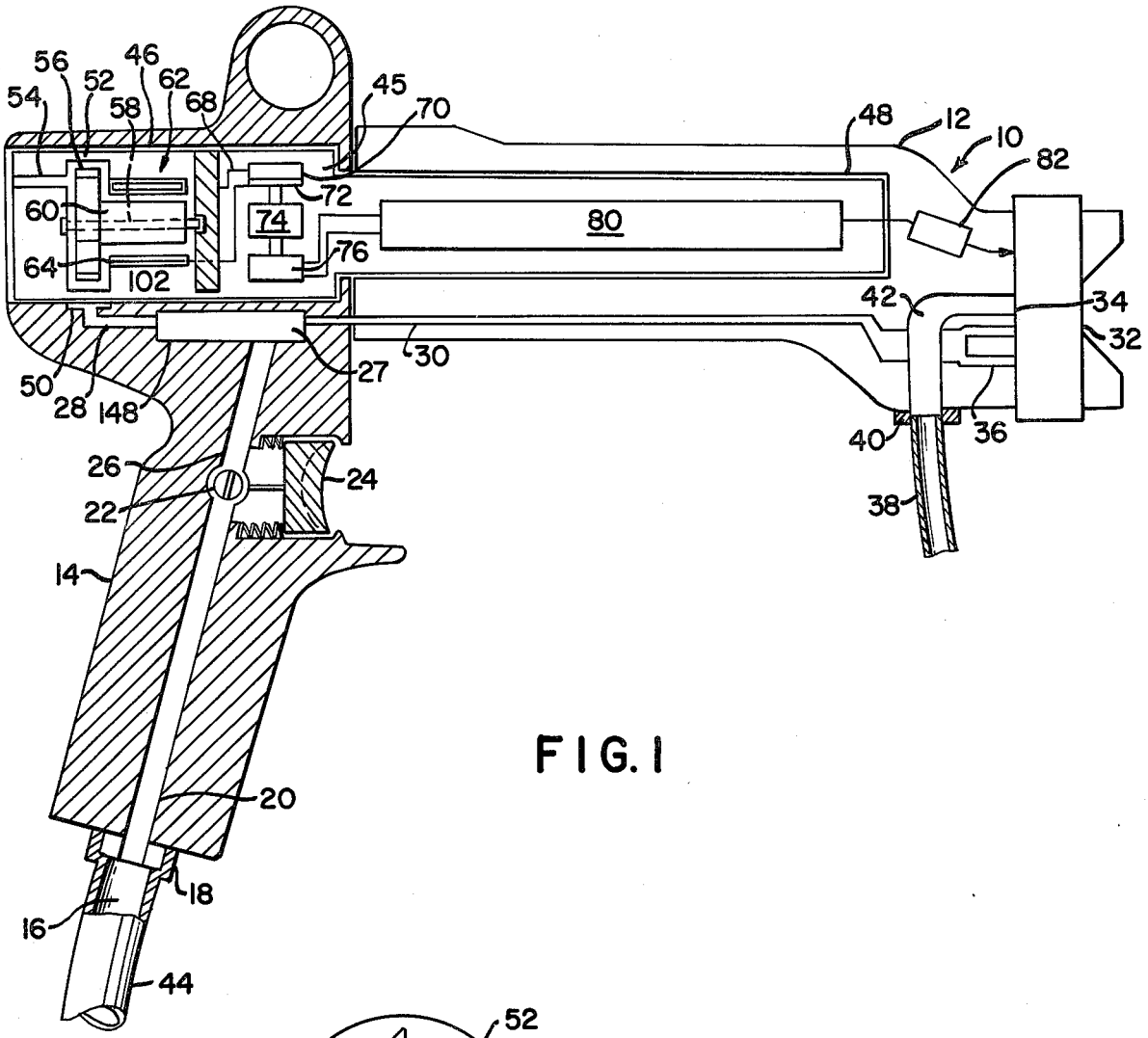
FIG. 1 is a schematic side elevational view, partly in section, showing the disposition of the various elements of an entirely self contained power supply disposed within a hand manipulable electrostatic spray gun of the air atomizing type.

Referring to the drawings and initially to FIG. 1, there is generally and schematically illustrated the components of a hand manipulable type of electrostatic spray gun 10 for paint spraying and the like in general accord with the construction disclosed in the aforesaid application Ser. No. 754,161. As there shown, such spray gun 10 includes a generally cylindrical and elongate barrel portion 12 formed of insulating material and a pistol grip type handle 14 formed of conducting material and whose upper portion encircles the rear end of the barrel portion 12. An air hose 16 connectable to a remote source of substantially constant pressure compressed air, suitably a conventional regulated compressed plant air supply capable of supplying air at a pressure of approximately 70 psig and at a flow rate of at least about 10 scfm, is connected to the base of the handle 14 through a suitable fitting 18.

As clearly shown in FIG. 1, a spray gun 10 constructed in accordance with the principles of this invention differs from those conventionally employed in both air atomized and airless electrostatic spray coating systems in that it has connected thereto only a paint supply line 38, an air supply line 16 and a ground connection and is totally devoid of external electrical power supply connections thereto. The subject construction thus completely dispenses with the heretofore required large and heavy floor supported electronic power supply units and the associated heavy and relatively inflexible insulated cables required to transmit the externally generated charging potentials to the gun, as well as also dispensing with the seeded air supply and the insulated electrical cable conventionally required to transmit the excitation potentials to electrogasdynamically powered spray gun assemblies.

Disposed within the handle 14 is an air flow conduit 20 connected to a flow control valve 22 operable through displacement of a trigger 24 by the user of the gun. The output side of the flow control valve 22 is connected to a conduit 26 which fluidly connects with a control valve and regulator assembly 27. Exiting from the control valve and regulator assembly 27 is a primary air flow conduit 30 and an auxiliary air flow conduit 28 within the gun barrel 12. The primary air flow conduit 30 serves (in an air atomized gun of the type described) to convey a flow of compressed air to an air cap assembly 32 wherein, as indicated by the further subdivided air flow conduits 34 and 36, such air may be used for conventional air induced atomization of the coating material introduced from a remote supply through a hose 38 and fitting 40 and conveyed to the air cap assembly 32 via conduit 42 and/or may be employed as "fan" air for shaping the emitted spray of the atomized coating material.

The structure and configuration of the air cap assembly 32 and the internal design of the air and coating material conduits therewithin may be essentially conventional in nature and U.S. Pat. Nos. 3,645,447, 3,693,877, 3,843,052 are exemplary of suitable constructions therefor. The electrode system incorporated in the air cap 32 may also be conventional, as is the grounding the conductive handle portion 14 by means of a conductive sheath 44 disposed around the air hose 16 or by means of a suitable ground lead associated therewith.

Disposed within the barrel portion 12 and the upper section of the handle portion 14 of the gun 10 is an elongate removable power supply cartridge member 45. The cartridge member 45 contains the hereinafter described operative components of the power supply and is of generally cylindrical configuration having a rear section 46 of appreciably greater diameter than its forward section 48.

When the cartridge 45 is properly seated within its complementally contoured receiving bore within the gun barrel 12, the auxiliary air flow conduit 28 is directly connected to the input nozzle 50 of a diminutive air motor assembly 52 to rotatably drive the rotor 56 thereof at high speed. The air flow through the air motor 52 may suitably be vented to the atmosphere through a muffled exhaust channel 54 at the rear of the gun barrel 12. The rotor 56 of the air motor 52 is mounted on a common shaft 58 with the armature 60 of an adjacent alternator 62 to form an effectively integral low inertia assembly capable of rapid acceleration to high speeds with a concomitant long life. The armature 60 is disposed within a cylindrical epoxy coated sleeve type stator 64, preferably of tape wound construction. The air motor 52 and the alternator 62 comprise an essentially integral subassembly that is both of small size, light weight, and low inertia. The described direct coupling of the air motor 52 with the alternator 62 operates to effect a direct conversion of kinetic energy available in the moving air stream in conduit 28 into electrical energy in the nature of an alternating voltage output from the alternator suitably of about 8–20 volts r.m.s. at a frequency of about 250 to 350 cycles/sec.

The alternating voltage output of the alternator 62 is then converted into a substantially constant DC voltage, suitably of about 8 to 20 volts in magnitude which in turn is employed to drive a high frequency oscillator 74 to produce a low voltage sine or square wave output suitably at a frequency in the range of from 10 to 50 kilohertz. The high frequency but low voltage output of the oscillator 74 is then raised by a transformer 76 to provide a high voltage alternating output at the specified frequency range.

The high frequency high voltage output of the transformer 76 is introduced into a long chain multiplier 80, suitably a series multiplier of about 20 or more stages, to elevate the input voltage into a desired 30 to 100 kilovolt rectified output voltage which is fed to the electrode assembly in the air cap 32 via lead 84 and a limiting resistance 82. A major part of limiting resistance 82 may alternatively be placed between the low voltage end of cartridge 45 and the grounded handle 14.

Figure 2:
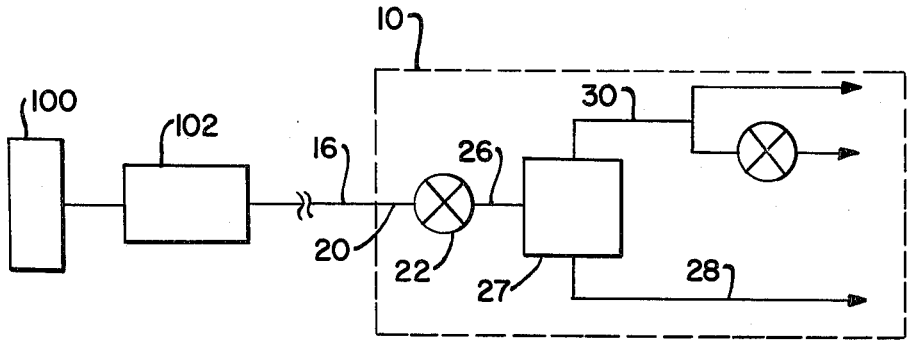
FIG. 2 is a schematic flow diagram indicative of the nature of flow of the gaseous prime movant in the disclosed system.

The critical size and weight limitations herein attendant electostatic spray coating apparatus, and particularly for hand manipulable spray guns, can be effectively satisfied by utilization of a prime movant air supply and flow system of the type schematically illustrated in FIG. 2. As there shown, the prime movant source comprises a conventional plant compressed air supply 100 that normally supplies clean air at pressures greater than 70 psig and at available flow rates in excess of 15 scfm. Such compressed air is initially introduced into an externally located, conventional and commercially available pressure regulator 102 adapted to provide a fixed and regulated supply of compressed air at 70 psig. A suitable regulator may, for example, be Binks No. 85-201 as manufactured and sold by Binks Manufacturing Company of Franklin Park, Ill. Such regulated air at 70 psig is introduced via the air hose 16 to the gun 10. Previous limitations on the effective length of air hose for electrostatic spray apparatus, which was about 25 feet, are now effectively removed and any length of air hose can now be employed. Air flow within the gun is primarily controlled by actuation of the trigger 24 and shift of the flow control valve 22 disposed within conduit 20 in the handle 14 from fully closed to fully opened condition. Downstream of trigger 24 the primary air flow within conduit 26 is introduced into the control valve and regulator assembly 27. Such control valve and regulator assembly 27 is operative to selectively and independently regulate the flow of air via conduit 30 to the air cap for both atomization of the coating fluid and fan width control, while also effecting a selective control of the flow of air at substantially fixed pressure to conduit 28 to the energy conversion unit. As will hereinafter become more apparent, the critical size and weight limitations attendant hand manipulable electrostatic spray guns narrowly confine permitted operating parameters necessary for high reliability and high efficiency operations. For example, the ability of the system to absorb and dissipate excess energy resulting from higher air supply pressure to the energy conversion unit is necessarily limited. Similarly a drop in supply air pressure results in less than desirable output voltages. Commensurately therewith, and because of the necessity of providing a constant pressure source of prime movant gas to the energy conversion unit, it is an equal necessity to provide a variable and controlled source of air for atomizing purposes.

Figure 3:
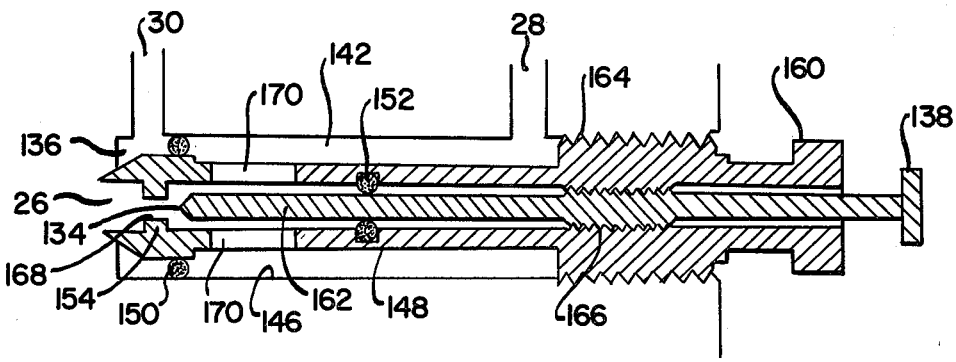
FIG. 3 is a sectional view of the air flow control valve and regulator assembly schematically shown in FIG. 1 for controlling the flow of prime movant air to the air motor and for independently regulating the flow of air to the atomizing head.

A presently preferred construction for a lightweight and diminutively sized control valve and regulator assembly, adapted to be disposed within the gun for performing such necessary functions and readily controllable by the operator, is illustrated in FIG. 3.

Such illustrated control valve and regulator assembly serves the dual functions of regulating the flow of air fed, via conduit 30, to the delivery end of the spray gun for use in atomization of the coating material and in fan spray pattern control and second of supplying air in controlled volumetric amounts and at substantially constant pressure to the air motor assembly.

As shown in FIG. 3 such control valve and regulator assembly is adapted to be mounted within a bore 146 within the rear of the gun barrel, with such bore 146 being in fluid communication with air inlet conduit 26 and air conduits 28 and 30. Such assembly is formed of a selectively shaped cylindrical sleeve 148 threadedly mounted in the bore 146, as at 164. The exposed end of the sleeve 148 terminates in a knob 160 for effecting longitudinal displacement of the sleeve 148 within bore 146 in response to rotation thereof. The forward end of sleeve 148 is tapered to provide a variable sized annular entry orifice 136 to the bore 146. The sleeve 148 includes a plurality of vent ports 170 near the forward end thereof.

Threadedly mounted, as at 166, within sleeve 148 is an elongate valve stem 162. The rear exposed end thereof terminates in a knob 138 for rotation relative to sleeve 148 and consequent longitudinal displacement of the pointed forward end 134 thereof relative to a restricted orifice 168 within the end of sleeve 148. Suitable O-rings 150 and 152 serve to selectively isolate air conduits 28 and 30 from each other.

In operation of the described assembly actuation of the trigger 24 results in air being supplied, from a remote source thereof and at a constant pressure, typically 70 psig, to air conduit 26. A portion of the air flows through the annular entry orifice 136, in an amount and at a pressure dependent upon the position of sleeve 148, and into conduit 30 for passage to the air cap for atomization and fan control usage. The remainder of said air flows through the restricted orifice 168, when open, through ports 170 into the bore 146 and outwardly thereof through conduit 28. The flow through conduit 28 will be essentially at the pressure of the air source, typically 70 psig, and its volume rate of flow will be controlled by the size of the aperture 50 adjacent the air motor 52.

Rotation of knob 160 displaces the assembly forward or backward permitting a greater or lesser flow of air through the annular orifice 136 which exits through the port connecting with conduit 30 in the barrel of the spray gun and thereinafter to the air cap for atomization purposes. Independently of the operation of knob 160 just described rotation of knob 138 acts to move the inner concentric valve stem 162 back or forth opening or closing the second air passage 134. When knob 138 is rotated anti-clockwise the valve is in the open position and air at the full inlet pressure typically 70 psig is fed to the air motor via chamber 142 and exit port 32. The screw threads and the fit of the O-rings 150 and 152 are preferably designed so that rotation of knob 138 rotates only valve stem 162 and not the body 148, thus permitting control of power for electrostatic spraying without affecting the setting of air for atomization. Similar rotation of knob 160 to control atomization does not affect the relative setting of the valve stem 162 and valve seat 154 and so does not simultaneously actuate the air supply to the air motor via port 132.

The critical size and weight limitations herein attendant electrostatic spray coating apparatus, and particularly for hand manipulable spray guns, pose a set of parametric dimensional requirements within which the additional operating requirements of effectively immediate operational response to trigger action, high reliability under all conditions of usage, and effectively complete freedom from maintenance must be met and satisfied. The obtaining of such objectives is largely dependent upon the primary energy conversion components, since these constitute the only portions of the power system that inherently require moving parts, high speed operation and effectively instantaneous acceleration.

The following portions of this specification will describe, in more detail, a presently preferred embodiment of a light weight energy conversion assembly for electrostatic spray guns that (a) is operable from conventionally available compressed air supplies of about 70 psig at flow rates of about 3 scfm; (b) provides an 8–20 volt alternating output at 5–10 watts; (c) provides desired output voltage to satisfy electrostatically enhanced deposition of spray coating material; and (d) is conveniently formed as a separable component of a replaceable cartridge assembly to facilitate field servicing of the spray equipment.

Figure 4:
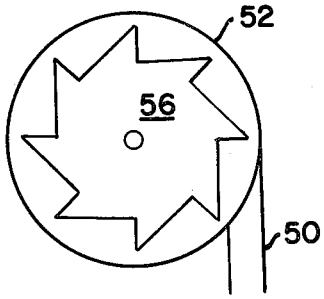
FIG. 4 is a schematic vertical section of a suitable air motor configuration.
Figure 5:
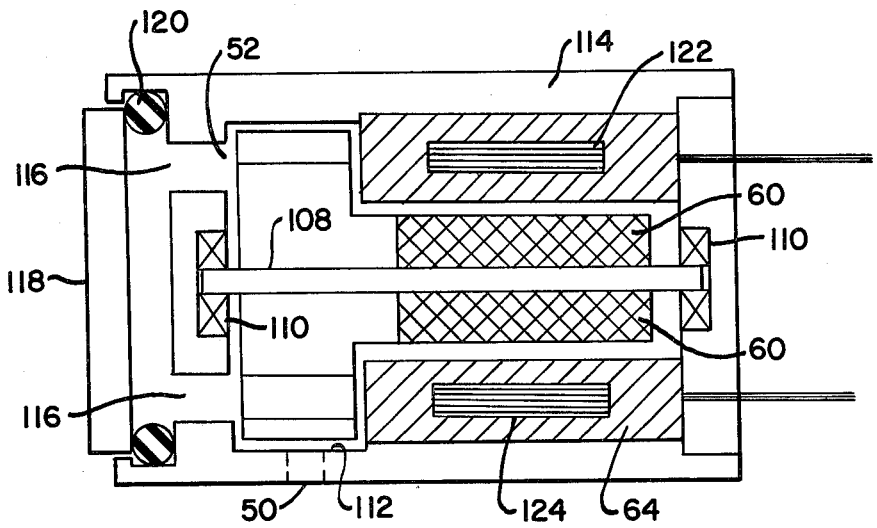
FIG. 5 is a schematic sectional view of a presently preferred air motor-alternator subassembly construction.

As best shown in FIGS. 4 and 5, a presently preferred construction for the air motor 52 comprises a simple impulse type air motor wherein a light weight rotor 56 of about 2.5 cm. in diameter which, when exposed to an entering air stream, moving at about 30 meter/sec. through nozzle 50, has a theoretical maximum speed of about 300,000 r.p.m., thus conveniently and readily permitting of operation at speeds in the order of 10,000 to 30,000 r.p.m. while providing the necessary torque to drive the alternator 62 in such manner as to provide the desired power output from the available kinetic energy in the moving air stream.

Compressed air flowing at about 3 scfm at a pressure of 70 psig has a theoretical power capability of about 250 watts. Since the desired output of the alternator is in the order of about 10 watts or less, the described system renders the full pressure drop available to drive the air motor 52 and associated alternator 62. Additionally, the above described preferred impulse turbine type of air motor avoids the utilization of sliding seals and permits the use of ball bearings, oil impregnated bushings or other suitable bearing elements, suitably of the type employed in dentists' drills and the like for long-lived high speed operation.

In order to obtain the desired rapid acceleration of the armature 60 of the alternator 62, the inertia of the air motor rotor 56 and armature 60 must be kept as small as possible.

To the above ends, the rotor 56 of the air motor 52 is about 2.5 cm. in diameter, about 0.6 cm. thick and is conveniently of light weight high strength resin such as "Delrin" as manufactured by DuPont. The rotor 56 is mounted adjacent one end of shaft 108 which is terminally supported in sealed ball bearings 110. The ball bearing mounted rotor 56 is disposed in close peripheral clearance within a chamber 112 formed in a shell housing 114. The prime movant air from conduit 28 is introduced through a selectively located and sized orifice 50 that is essentially tangentially oriented relative to the rotor periphery and is about 0.15 cm. in diameter. The diameter of the aperture 50 is selected to provide air exiting into chamber 112 in the vicinity of sonic velocity and to limit flow to approximately 3 scfm. After impingement on the blade surfaces of rotor 56, such air is vented from chamber 112 through one or preferably a number of ports 116. Disposed downstream of the ports 116 is a muffler plate 118 disposed in peripheral engagement with an O-ring 120, for venting such exiting air to the atmosphere from the rear of the gun with minimal noise. A suitable muffler 118 comprises a sintered ceramic or metal disc of about 0.3 cm. thickness.

Figure 6:
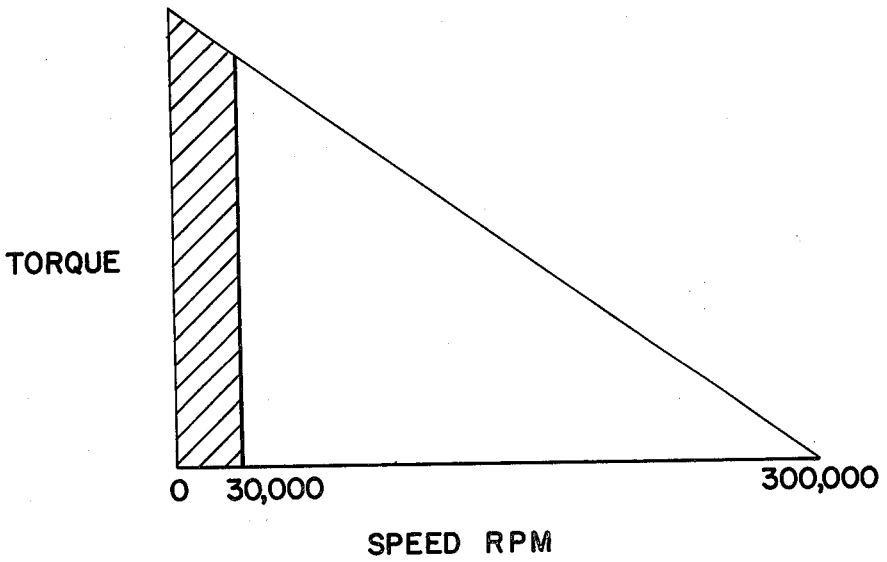
FIG. 6 is a schematic representation of the typical performance characteristics of the air motor.

As shown in FIG. 6 the torque speed characteristic of the described impulse type turbine, shows that output torque is essentially inversely proportional to speed of rotation. As such, desirable torque levels are achieved at speeds of less than 30,000 r.p.m. as represented by the shaded portion under the curve. Such torque-speed limitation poses a further operating parameter upon the design of the alternator 62.

The alternator unit functions to convert the rotational kinetic energy of the air motor rotor 56 into electrical energy which in turn serves as the electrical power source for the high voltage for the electrostatically enhanced deposition of the spray coating material. As previously described, such generator unit should provide a power output of from 5 to 10 watts at an output voltage of at least 5 and preferably greater than 10 volts and should do so with low losses and internal dissipation and in a highly reliable manner through avoidance of any brushes, wipers or other commutating means. The above objectives must be satisfied in an assembly that is both small in size and weight and is possessed of minimal inertia.

To the above ends the alternator 62 is disposed immediately adjacent to the rotor 56 and within the common housing 114. The armature 60 is mounted on shaft 108 and is directly driven by rotor 56. Such armature 60 preferably comprises a high energy permanent magnet about $\frac{5}{8}$ inch long and about $\frac{1}{2}$ inch in diameter, magnetized across a diameter thereof. Present knowledge indicates that magnet diameters in excess of $\frac{1}{2}$ inch are attended by unacceptable inertia characteristics. Alnico 8 is a preferred material for such magnet armature although other materials including Alnico 5 can also be used. As best shown in FIG. 5, the stator 64 of the alternator 62 consists of a hollow cylindrical tape wound core 122 of high permeability alloy steel to minimize hysteresis and eddy current loses. Toroidally wound about the core 122 are a pair of coils 124 serving as the stator winding. Such coils are selected to provide an output voltage as previously indicated and to match the impedance requirements of the downstream electrical components such as the rectifier 70, voltage regulator 72 and oscillator 74. The entire stator and winding assembly is encapsulated or potted as indicated at 102 to provide a monolithic type structure. The above described alternator 62 is of simple and rugged construction and is characterized by a low starting torque that permits the rapid attainment of an operating speed of about 15,000 r.p.m. in less than $\frac{1}{4}$ second to effect delivery of the required power.

Having thus described my invention, I claim:

1. In electrostatic spray coating, apparatus having a self contained electrical power supply devoid of external electrical connection thereto, means for converting the kinetic energy of a moving air stream into electrical energy comprising, rotatable turbine means having a low moment of inertia peripherally exposed to a stream of air moving at high speed for converting the kinetic energy of said stream of air into kinetic energy of a rotating mass, alternator means having a low moment of inertia and a common axis of rotation with said turbine means and directly driven thereby, said rotatable turbine means and alternator means jointly constituting a composite low moment of inertia rotatable means accelerable from rest to an operating speed of over 10,000 r.p.m. in less than ¼ second for rapidly converting the kinetic energy of said stream of air into alternating electrical energy suitable for use as a primary electrical power source for said electrostatic spray coating apparatus.

2. Apparatus as set forth in claim 1 wherein said turbine means comprises an impulse type air motor.

3. Apparatus as set forth in claim 1 wherein said alternator means includes a solid magnet armature magnetized across a diameter thereof.

4. Apparatus as set forth in claim 1 wherein said alternator means includes a stator comprising a tape wound core having at least a pair of coils toroidally wound thereabout.

5. Apparatus as set forth in claim 1 wherein said stream of air is derived from a remote source thereof and has a volumetric flow rate of about 3 scfm.

6. Apparatus as set forth in claim 1 wherein said alternator means is adapted to provide a power output of from 5 to 10 watts at an output voltage of at least 5 volts within ¼ second after starting from rest.

7. In electrostatic spray coating apparatus having a self contained electrical power supply devoid of external electrical connections thereto, means for converting the kinetic energy of a moving air stream into electrical energy comprising, an impulse type air motor having a low moment of inertia for converting the kinetic energy of a moving air stream from a remote source thereof into kinetic energy of a rotating mass and alternator means having a solid magnet armature of low moment of inertia and magnetized across a diameter thereof, disposed coaxially with said air motor and directly driven thereby, said air motor and alternator means jointly constituting a low moment of inertia rotatable mass accelerable from rest to an operating speed of over 10,000 r.p.m. in less than ¼ second for rapidly converting the kinetic energy of said stream of air into alternating electrical energy suitable for use as a primary electrical power source for said electrostatic spray coating apparatus.

8. Apparatus as set forth in claim 7 including control and regulating means disposed intermediate said air motor and said remote source of said stream of air for effecting a constant flow of said air to said turbine means at a fixed pressure and of a kinetic energy content to provide an alternating electrical power output from said alternator of at least 5 watts.

9. Energy conversion apparatus for effecting the rapid conversion of the kinetic energy of a moving stream of air into electrical energy comprising, a perimetric housing defining a pair of coaxially aligned cylindrical chambers therewithin, rotatable turbine means having a low moment of inertia disposed in one of said chambers, alternator means having a rotor with a low moment of inertia on a common axis of rotation with said turbine means and adapted to be directly driven thereby disposed in said second chamber, said turbine means and alternator means jointly constituting a composite low moment of inertia rotatable mass accelerable from rest to an operating speed of over 10,000 r.p.m. in less than ¼ second, means for directing a stream of air moving at high speed into said first chamber into driving engagement with said turbine means to convert the kinetic energy of said air stream into kinetic energy of rotation of said turbine means and alternator rotor, and stator means included in said alternator means and forming at least a portion of the defining walls of said second chamber for converting the kinetic energy of said rotating rotor into electrical energy.

10. Apparatus as set forth in claim 9 wherein said turbine means comprises an impulse type air motor periperally engaged by said stream of air tangentially directed relative thereto.

11. Apparatus as set forth in claim 9 wherein said rotor comprises a solid magnet armature magnetized across a diameter thereof and said stator comprises a tape wound core having at least a pair of coils toroidally wound thereabout.

12. Apparatus as set forth in claim 9 wherein said stream of air is derived from a remote constant pressure source thereof and has a volumetric flow rate of about 3 scfm.

13. Apparatus as set forth in claim 9 wherein said perimetric housing and the components contained therein comprise a replaceable cartridge subassembly.

14. Apparatus as set forth in claim 12 wherein said alternator means is adapted to provide a power output of from 5 to 10 watts at an output voltage of at least 5 volts within ¼ second after starting from rest.

15. Apparatus as set forth in claim 9 wherein said means for directing a stream of air into said first chamber includes control valve regulating means disposed intermediate said chamber and a remote source of constant pressure compressed air for effecting a constant flow of said air at substantially fixed pressure into said first chamber.

16. Apparatus as set forth in claim 1 wherein said stream of air is derived from a remote constant pressure source thereof and further comprising control and regulating means disposed intermediate said turbine means and said remote source of said air for directing a constant flow of a portion of said air at substantially fixed pressure to said turbine means and for directing the remainder thereof at a selected pressure for adjunct spray usage.

* * * * *